United States Patent [19]

Spunt

[11] 3,959,937

[45] June 1, 1976

[54] MODULAR DOME STRUCTURE

[76] Inventor: Leonard Spunt, 7809 McNulty St., Canoga Park, Calif. 91306

[22] Filed: June 17, 1974

[21] Appl. No.: 479,611

[52] U.S. Cl. ..... 52/81
[51] Int. Cl.[2] ..... E04B 1/32
[58] Field of Search ..... 52/80, 81, DIG. 10

[56] References Cited

UNITED STATES PATENTS

| | | | |
|---|---|---|---|
| 2,905,113 | 9/1959 | Fuller | 52/81 |
| 2,914,074 | 11/1959 | Fuller | 52/81 |
| 2,956,806 | 10/1960 | Routson | 52/DIG. 10 |
| 3,093,461 | 6/1963 | Wolven | 52/DIG. 10 |
| 3,105,969 | 10/1963 | Banche | 52/81 |
| 3,186,522 | 6/1965 | McCauley | 52/81 |
| 3,276,148 | 10/1966 | Snelson | 52/DIG. 10 |
| 3,676,976 | 7/1972 | McAllister | 52/81 |
| 3,724,149 | 4/1973 | Detman | 52/81 |

FOREIGN PATENTS OR APPLICATIONS

| | | | |
|---|---|---|---|
| 741,047 | 8/1966 | Canada | 52/81 |
| 1,282,156 | 12/1961 | France | 52/80 |
| 843,529 | 8/1960 | United Kingdom | 52/80 |

OTHER PUBLICATIONS

Geodesics by E. Popko, 1968, by U. of Detroit Press, p. 5, figures 1,5,62,69–78.

*Primary Examiner*—Ernest R. Purser
*Assistant Examiner*—Henry Raduazo
*Attorney, Agent, or Firm*—Lindenberg, Freilich, Wasserman, Rosen & Fernandez

[57] ABSTRACT

A dome structure is provided which is constructed of identical ring-shaped elements of arbitrary size relative to the radius of the dome, the ring elements extending along four or five meridian lines that pass through the zenith of the dome and with additional elements positioned in curved rows lying progressively further from the zenith and with each element attached at its periphery to four other elements. The elements are constructed with tapered peripheries to lie solidly against one another, and with radially extending ribs that prevent deformation of the ring members into an oval shape.

7 Claims, 11 Drawing Figures

MODULAR DOME STRUCTURE

BACKGROUND OF THE INVENTION

This invention relates to an improved building construction for domes or other spherical frames.

Domes are attractive architectural shapes, but their use has been limited because they are generally expensive to construct. In conventional dome construction, the frame of the dome consists of many different sizes of struts, with the number of different sizes growing larger as the dome size increases for a given maximum length of the struts. For example, the geodesic dome frame by Fuller, described in U.S. Pat. No. 2,682,235, requires five different lengths of struts for a 4-frequency dome (the edge of the regular icosahedron divided into four) and requires 56 different strut lengths for a 16 frequency dome. In the larger domes where higher frequencies are utilized, the lamella system described in U.S. Pat. No. 2,908,236, and employed in the Astrodome in Houston, Tex., enables the use of fewer different strut lengths. The lamella system has been used to construct spherical roof frames of up to 640 feet clear span, using only 14 different lengths of girders. While these systems reduce the cost of dome structures as compared to other coventional designs, they still require many different frame elements of large size and require precise fabrication of these elements, which leads to a relatively high cost for dome structures. An important cost-contributing factor is that highly skilled workmen are required in order to properly assemble dome structures that have many large size, slightly different elements.

SUMMARY OF THE INVENTION

In accordance with one embodiment of the present invention, a dome structure is provided which utilizes a single element and wherein the elements can be joined in an easily-understood arrangement to construct the dome. Each of the elements is of a largely ring shape, and the dome is constructed by first positioning an element at the zenith of the dome and joining additional elements along four or five equally spaced meridian lines extending from the zenith. Then, additional elements are mounted in rows progressively descending from the zenith, with each row extending between two lines of elements that lie on the meridians. The dome can be constructed in a regular manner to cover up to 85 per cent of the surface of a hemisphere, which is usually about the maximum that is required in building construction. The bottom row extending between two meridian lines forms a natural arch that can serve as an entrance into the dome.

In one dome structure, each of the elements is tapered along the periphery to form a frustum of a cone, in order to allow the elements to firmly abut one another. In addition, each element has four identical radially-extending ribs that resist deformation of the element into an oval shape.

DESCRIPTION OF THE PREFERRED EMBODIMENTS

Figure 3:
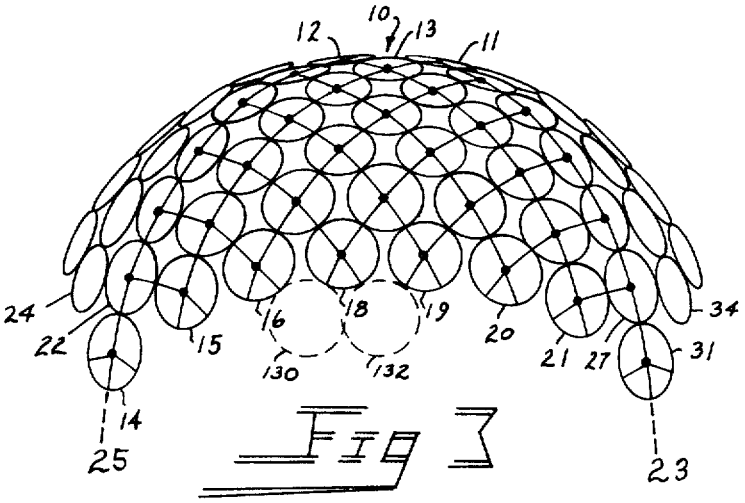
FIG. 3 is a simplified side elevation view of a dome frame constructed in accordance with the present invention.
Figure 4:
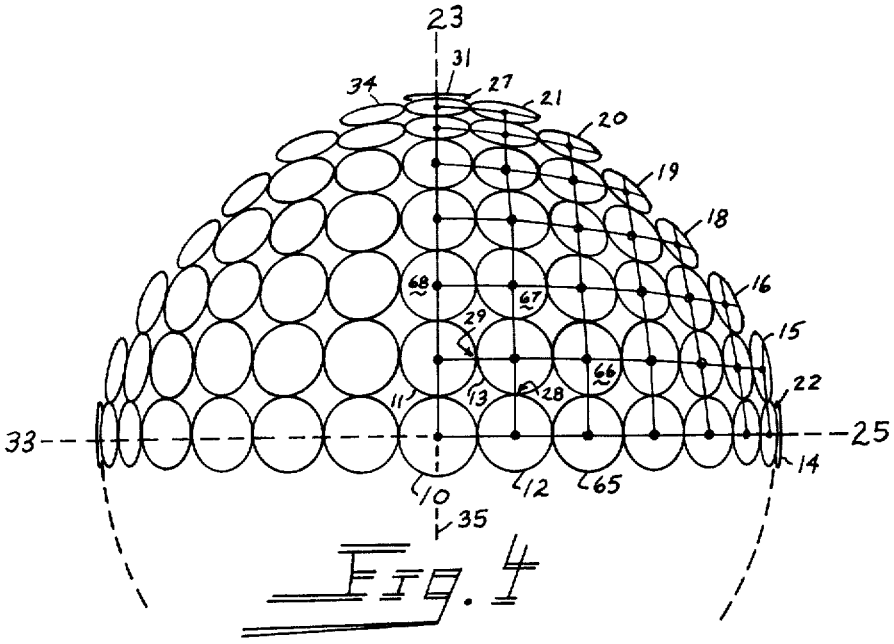
FIG. 4 is a partial plan view of the structure of FIG. 3.

FIGS. 3 and 4 illustrate a dome constructed in accordance with the present invention, which utilizes numerous identical ring-shaped elements. The dome is constructed by positioning a center element 10 at the zenith or pole of the dome and then positioning elements along several great circle meridians, such as along the meridian lines 23 and 25. Thus, for example, elements 12 and 65 are arranged along the meridian line 25. As will be explained below, the elements can be arranged along up to five meridian lines extending from the crown or zenith element 10, although arrangement of the elements along only four meridian lines is often preferred. After the zenith element and meridian elements have been positioned, additional elements are positioned in rows that progressively descend from the zenith. A first row includes only element 13, whose upper portion lies in the gap between elements 12 and 11, and which extends between meridian elements 65 and 68. The second row includes elements 66 and 67 which respectively fill gaps between elements 65 and 13 and between elements 13 and 68. The elements are positioned in progressively descending rows until the last row is positioned, which includes elements 15, 16, 18, 19, 20 and 21, which extend between meridian elements 14 and 31.

The initial positioning of the zenith element 10 and the elements lying on the meridian lines such as 23 and 25 is relatively straightforward. The positioning of the first row, consisting of element 13, is also straightforward, with this element merely being positioned so that it abuts the elements 12 and 11, as at the points 28, 29. The next row, consisting of elements 66 and 67 can also be positioned in a simple manner, by locating them so that each of them abuts two other elements. Thus, the pattern of elements can be formed in a straightforward manner, without requiring detailed and complicated instructions, as might be required where a plurality of different sized or different shaped elements was utilized throughout the structure.

The dome structure of this invention generates a natural arch at the bottom of the dome. Thus, the lowest row which comprises elements 15, 16, 18, 19, 20 and 21, automatically assumes a natural arch shape. With ring 14 and 31 deleted, minor arches are formed about meridian lines 25 and 23 (rings 15, 22 and 24, and rings 21, 27 and 34) and a lower arch is formed in the center of the quadrant. These arches provide entrances and exits as well as view openings, without introducing discontinuities into the simple and natural abutment pattern of the framework.

Figure 9:
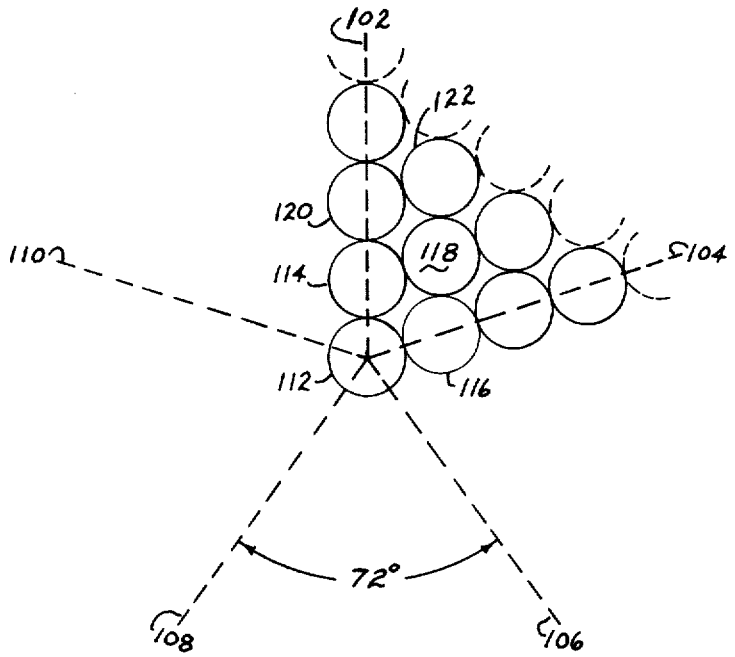
FIG. 9 is a partial plan view of a dome constructed in accordance with another embodiment of the invention.

The dome can be designed with the ring-shaped elements extending along four meridian lines such as lines 23, 25, 33 and 35, which are spaced 90° from one another at the zenith. It is also possible to initially arrange the rings along five meridian lines such as those shown at 102–110 in FIG. 9, where adjacent meridian lines are spaced 72° from one another. If it is attempted to utilize six or more meridian lines, the ring elements adjacent to the crown ring at the zenith of the dome will overlap and therefore interfere with one another.

Where four or five meridian lines are utilized the rings are self aligning. In FIG. 4, it can be seen that the rings 11 and 12 create a cavity between them, and the ring 13 is placed in this cavity so as to be mutually tangent to rings 11 and 12. The installation of ring 13 creates a similar cavity between rings 13 and 65, into which ring 66 is placed. This progressive abutment process is continued until a natural horizontal boundary arch is obtained such as that formed by rings 15, 16, 18, 19, 20 and 21 in FIG. 3. A similar process is utilized in constructing the portion of the five-meridian line dome shown in FIG. 9, with ring 118 placed between the meridian elements 114, 116, the ring 122 placed between the rings 118, 120, etc. As rings are thus laid to form a dome, the rings progressively further from the zenith ring 112 form progressively smaller gaps. In the case of a four-meridian dome of the type shown in FIGS. 3 and 4, up to 85 per cent of a hemispherical surface can be covered before any further rings would interfere with one another, such as the imaginary rings shown at 130, 132 in FIG. 3. In the case of a five meridian dome of the type shown in FIG. 9, only 70 per cent of a hemisphere can be covered before the rings will interfere with one another. Of course, additional rings can be utilized to further extend the domes by leaving gaps or by utilizing structural members other than one size of ring, but this results in increased complexity of manufacture and assembly. It may be noted that for a five meridian line division, the crown ring 112 at the zenith of the dome would require a fifth rib. All other ring elements in the pattern would contain four ribs. In effect, the same modular element could be employed to construct either a four meridian or a five meridian dome of a given radius with the exception of the zenith module.

Figure 1:
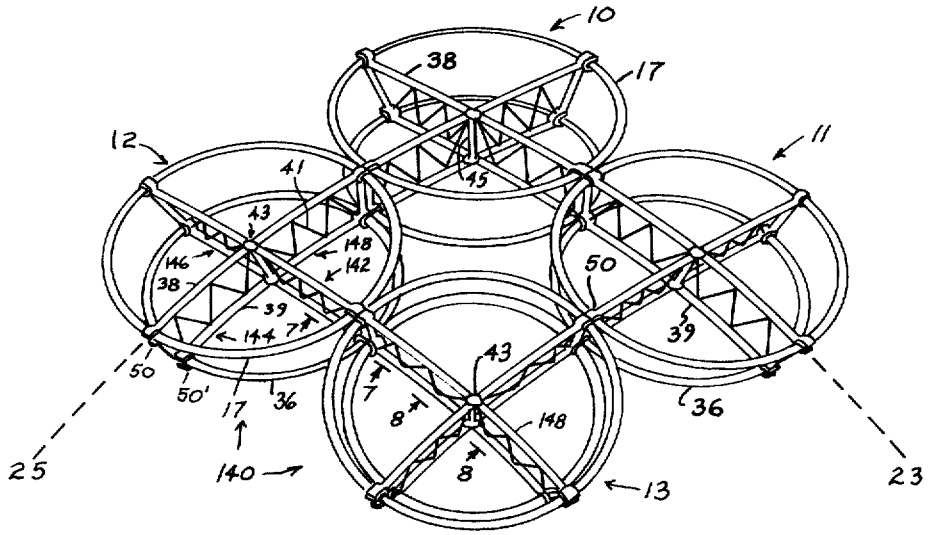
FIG. 1 is a perspective view showing four abutting and attached modules or elements of a dome constructed in accordance with the present invention.

While it is possible to utilize thin rings of simple toroidal shape or other simple form, the resulting domes are not strong because rings can readily be deformed to an oval shape or can be warped out of a simple plane. FIG. 1 shows ring-shaped modular units 140 whose peripheries are arranged along conical imaginary surfaces and which have strengthening ribs. The figure shows four abutting modular units, each having upper and lower rings 17, 36 and four ribs of the same length 142, 144, 146 and 148 that extend from the center of the module at 43 to the periphery at the rings 17 and 36. The ribs are of conventional lattice girder construction, each having upper and lower members 38, 39 and diagonal struts 41 extending between them. The four ribs pivot about the axis 43 of the modular unit and can slide along the rings 17, 36. The outer ends of the ribs have brackets 50 that not only slideably support the ribs on the rings, but which also enable attachement of a pair of elements or modules together.

Figure 7:
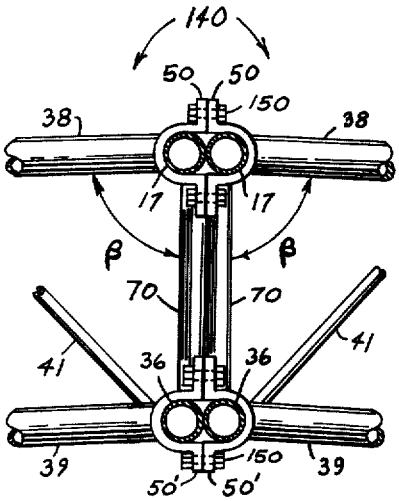
FIG. 7 is a partial detailed view taken on the line 7—7 of FIG. 1.
Figure 8:
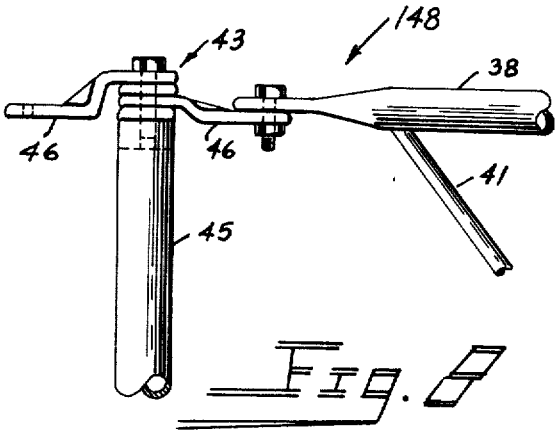
FIG. 8 is a detailed view taken on the line 8—8 of FIG. 1.

FIG. 7 illustrates the manner in which a pair of modular units 140 is connected, the two brackets 50 at the upper rings 17 being fastened together by bolt and nut fasteners 150 and the two brackets 50' along the bottom rings 36 being similarly fastened together. Bracket 50 is attached, as by welding, to upper rib chord member 38 and axial spacing member 70. Similarly bracket 50' is attached to lower chord member 39 and spacer 70. This provides spacing for upper and lower rings 17 and 36 and, thru a sliding action, provides for positioning of the ribs to points of abutment with adjacent ring elements. As shown in FIG. 8, the pivot region 43 at the center of a modular unit has four pivot brackets 46 at an end thereof, which pivotally support each of the four ribs such as 148. The pivot brackets 46 are secured to axial spacing member 45, the member 45 providing the prescribed depth to the module as will be described below.

Figure 5:
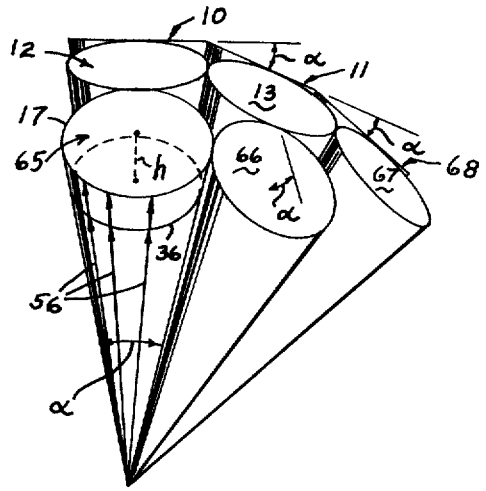
FIG. 5 is a perspective view demonstrating the arrangement of modular elements of the invention.
Figure 6:
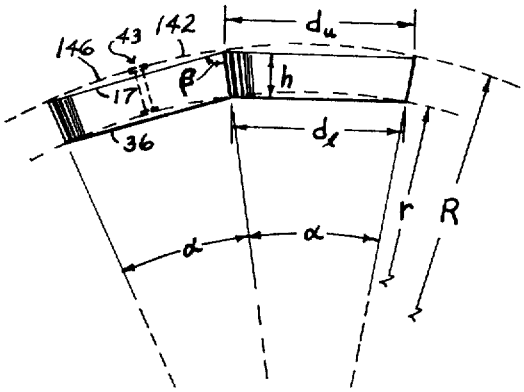
FIG. 6 is a partial side elevation view showing the design factors in constructing the modular elements for a dome.

FIGS. 5 and 6 illustrate the manner in which the dimensions of the modular elements of FIG. 1 can be determined for a dome of given radius of curvature. It is only necessary that the lower and upper rings 36, 17 lie on the surface of cones whose apexes meet at the center of curvature of the spherical surface to be formed. Inasmuch as each point on the upper ring 17 is a constant distance indicated at 56 (FIG. 5) from the apex of the cone, it can be seen that the ring member conforms precisely to the outer spherical surface of radius R. This property also applies to lower ring 36 for the inner spherical surface of radius $r$. An important point to be noted is that the diameter of the ring-shaped modular unit can be of any desired size for a given dome radius R. One method of design is to first choose a diameter $d_u$ of the upper or outer ring 17 which will enable the modular units to be readily handled and transported, and to choose an axial spacing or depth h of the unit which will provide sufficient strength to prevent deformation of the unit by warpage out of a plane. The diameter $d_1$ of the inner or lower ring 36 is then determined by the fact that the upper and lower rings must lie on the surface of an imaginary cone whose apex is at the center of the spherical surface to be formed. The ribs such as 142, 146 can be curved to follow the surface of the sphere or may be straight. The angle $\beta$ between upper rib chord 38 and axial spacer 70 will be 90° for curved ribs and the complement of the cone half-angle, $\alpha/2$, for straight ribs. As illustrated in FIGS. 5 and 6, the cone angle $\alpha$ is the common abutment angle of the planes of any two adjacent elements.

In assembling the ring-shaped modules 140, it is required to position the ribs such as 142 so that they extend along the directions of compressive loading of the rings to stiffen the rings against deformation. Thus, by constructing the elements to permit pivoting of the ribs as in the modular elements of FIG. 1, efficient utilization is made of the material in the modular elements.

Figure 2:
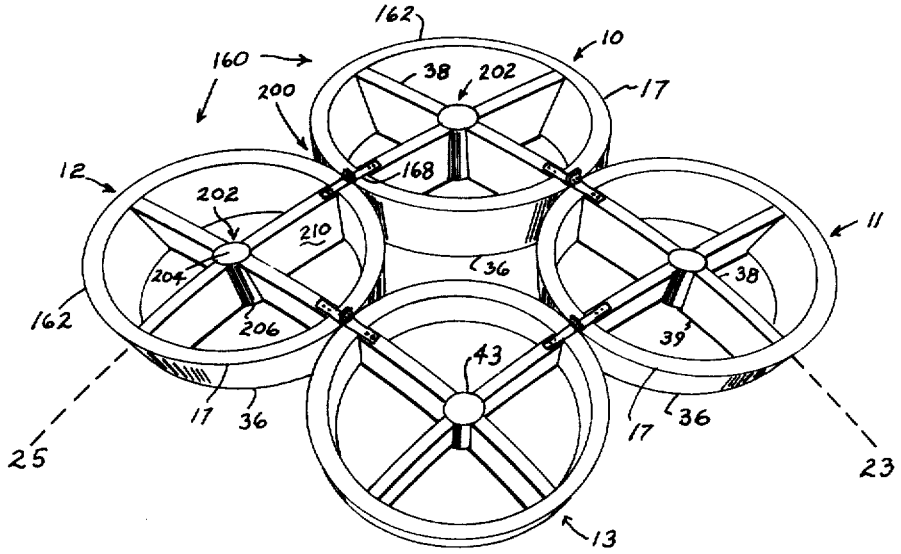
FIG. 2 is a perspective view of four abutting modular units constructed in accordance with another embodiment of the invention.
Figure 10:
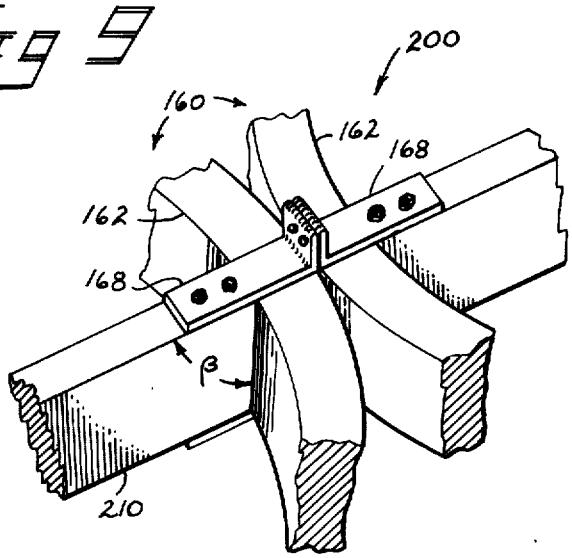
FIG. 10 is a partial perspective view showing details of a fastener of FIG. 2.
Figure 11:
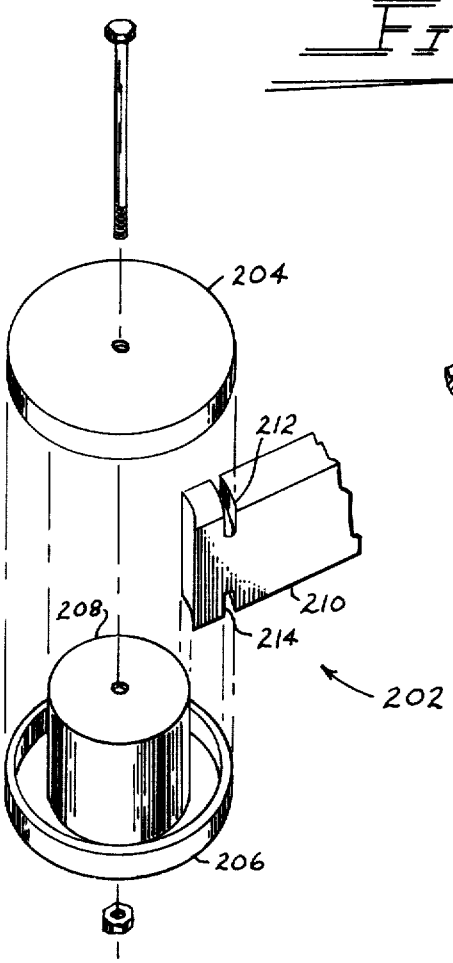
FIG. 11 is an exploded perspective view showing details of the pivot connection of FIG. 2.

FIG. 2 illustrates modules or elements 160 which utilize solid rims 162 that are tapered to lie on the surface of an imaginary cone. Adjacent elements can be joined together at 200 with a variety of fasteners such as the fasteners 168 shown in FIG. 10. The pivot connection 202 shown in exploded detail in FIG. 11, is comprised of an upper lipped cover plate 204 and an identical lower cover plate 206 to which a cylindrical drum 208 is attached. The pivot end of rib 210 is contoured to conform to the drum and is grooved at 212 and 214 so as to ride on the cover lips.

Although particular embodiments of the invention have been described and illustrated herein, it is recognized that modifications and variations may readily occur to those skilled in the art and consequently, it is intended that the claims be interpreted to cover such modifications and equivalents.

The embodiments of the invention in which an exclusive property or privilege is claimed are defined as follows:

1. A dome structure comprising:

a multiplicity of elements with substantially circular peripheries, each of the same diameter, said elements disposed on the surface of an imaginary dome that has a predetermined pole location, and most of said elements fastened near their peripheries to the peripheries of only four other of said elements to form the frame of a dome;

said elements including a first plurality of elements arranged along four imaginary meridian lines that pass through said pole location, and at least three sets of additional elements arranged in progressively lower rows, with an element in each row positioned with its upper end bridging the gap left between a pair of elements in the next higher row.

2. The dome structure described in claim 1, wherein:

the bottom most of said rows forms an arch and the region under said bottom most rows is left substantially unobstructed to the view, whereby to form a naturally arched view way.

3. A dome structure comprising:

a multiplicity of elements with substantially circular peripheries, each of the same diameter, said elements disposed on the surface of an imaginary dome that has a predetermined pole location, and most of said elements fastened near their peripheries to the peripheries of only four other of said elements to form the frame of a dome;

said elements including a first plurality of elements arranged along five imaginary meridian lines that pass through said pole location, and sets of additional elements arranged in progressively lower rows, with an element in each row positioned with its upper end bridging the gap left between a pair of elements in the next higher row.

4. The dome structure described in claim 3, wherein:

the bottom most of said rows forms an arch and the region under said bottom most rows is left substantially unobstructed to the view, whereby to form a naturally arched view way.

5. A dome structure comprising:

a multiplicity of elements with substantially circular peripheries, each of the same diameter, said elements disposed on the surface of an imaginary dome, and most of said elements fastened near their peripheries to the peripheries of only four other of said elements to form the frame of a dome;

each of a plurality of said elements including four ribs extending radially from the center of the ring to the periphery thereof, said ribs being adjustable in position to contact different locations along the periphery of the element, and some of said elements having ribs positioned at different relative angles to one another than the ribs of different elements.

6. A dome structure comprising:

a multiplicity of elements of substantially the same size disposed on the surface of an imaginary dome that has a predetermined pole location, with said elements fastened near their peripheries to the peripheries of only four other of said elements to form the frame of a dome;

said elements including a first plurality of elements arranged along four imaginary meridian lines that pass through said pole location, and at least four sets of additional elements arranged in at least four progressively lower rows, with an element in each row positioned with its upper end bridging the gap left between a pair of elements in the next higher row.

7. A dome structure comprising:

a multiplicity of elements of substantially the same size disposed on the surface of an imaginary dome that has a predetermined pole location, with most of said elements fastened near their peripheries to the peripheries of four other of said elements to form the frame of a dome;

said elements including a first plurality of elements arranged along five imaginary meridian lines that pass through said pole location, and sets of additional elements arranged in progressively lower rows, with an element in each row positioned with its upper end bridging the gap left between a pair of elements in the next higher row.

* * * * *